US007673968B2

(12) United States Patent
Ogle et al.

(10) Patent No.: US 7,673,968 B2
(45) Date of Patent: Mar. 9, 2010

(54) PRINTING DEVICE LOCKING MECHANISM FOR CONSUMABLE ENCLOSURES

(75) Inventors: Holli C. Ogle, Corvallis, OR (US); Ralph L. Stathem, Corvallis, OR (US); Jefferson P. Ward, Bush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 524 days.

(21) Appl. No.: 11/627,904

(22) Filed: Jan. 26, 2007

(65) Prior Publication Data

US 2008/0181713 A1 Jul. 31, 2008

(51) Int. Cl.
*B41J 2/14* (2006.01)
*B41J 2/16* (2006.01)

(52) U.S. Cl. ..... 347/49; 347/85; 347/86

(58) Field of Classification Search ..... 347/9, 347/14, 19, 20, 37, 50, 85–87, 49; 400/286.2, 400/286.3, 294.2; 358/1.14, 501–502
See application file for complete search history.

(56) References Cited

U.S. PATENT DOCUMENTS

| | | | | |
|---|---|---|---|---|
| 5,519,422 | A * | 5/1996 | Thoman et al. | 347/49 |
| 6,466,922 | B1 * | 10/2002 | Abumehdi | 705/410 |
| 7,393,091 | B2 * | 7/2008 | Kumagai et al. | 347/86 |
| 2003/0053108 | A1 | 3/2003 | Clough et al. | |
| 2003/0063147 | A1 | 4/2003 | Walker | |
| 2003/0206215 | A1 | 11/2003 | Walker | |
| 2005/0243118 | A1 | 11/2005 | Ward et al. | |
| 2006/0265742 | A1 | 11/2006 | Rommelmann et al. | |

* cited by examiner

*Primary Examiner*—Juanita D Stephens

(57) ABSTRACT

A user inserts one or more consumable enclosures into one or more corresponding slots of a printing device. The user engages a locking mechanism of the printing device into a corresponding feature of each consumable enclosure. The printing device detects user engagement of the locking mechanism. In response to the user performing a consumable enclosure-related action, the printing device substantially impedes user access to the locking mechanism and the consumable enclosures until the user has entered an unlock code.

20 Claims, 8 Drawing Sheets

PRINTING DEVICE LOCKING MECHANISM FOR CONSUMABLE ENCLOSURES

BACKGROUND

Printing devices, such as printers, are devices that are capable of forming images and text on media, such as paper. Examples of such printing devices include inkjet printers, which eject ink onto media to print on the media, and laser printers, which employ toner to print on the media. While many printing devices are used in private settings such as homes of users and private offices of users, other printing devices are used in more public settings, such as enterprise settings like offices, as well as libraries, schools, and so on.

A relatively expensive component of a printing device is the colorant enclosure that contains the colorant supply by which the printing device is able to print on media. For instance, in the case of an inkjet printer, such a colorant enclosure may be an inkjet cartridge containing ink, and which may also contain an inkjet printhead, whereas in the case of a laser printer, such a colorant enclosure may be a toner cartridge containing toner. An issue with printing devices located in public settings is that these colorant supplies are susceptible to theft.

DETAILED DESCRIPTION

Figure 1:
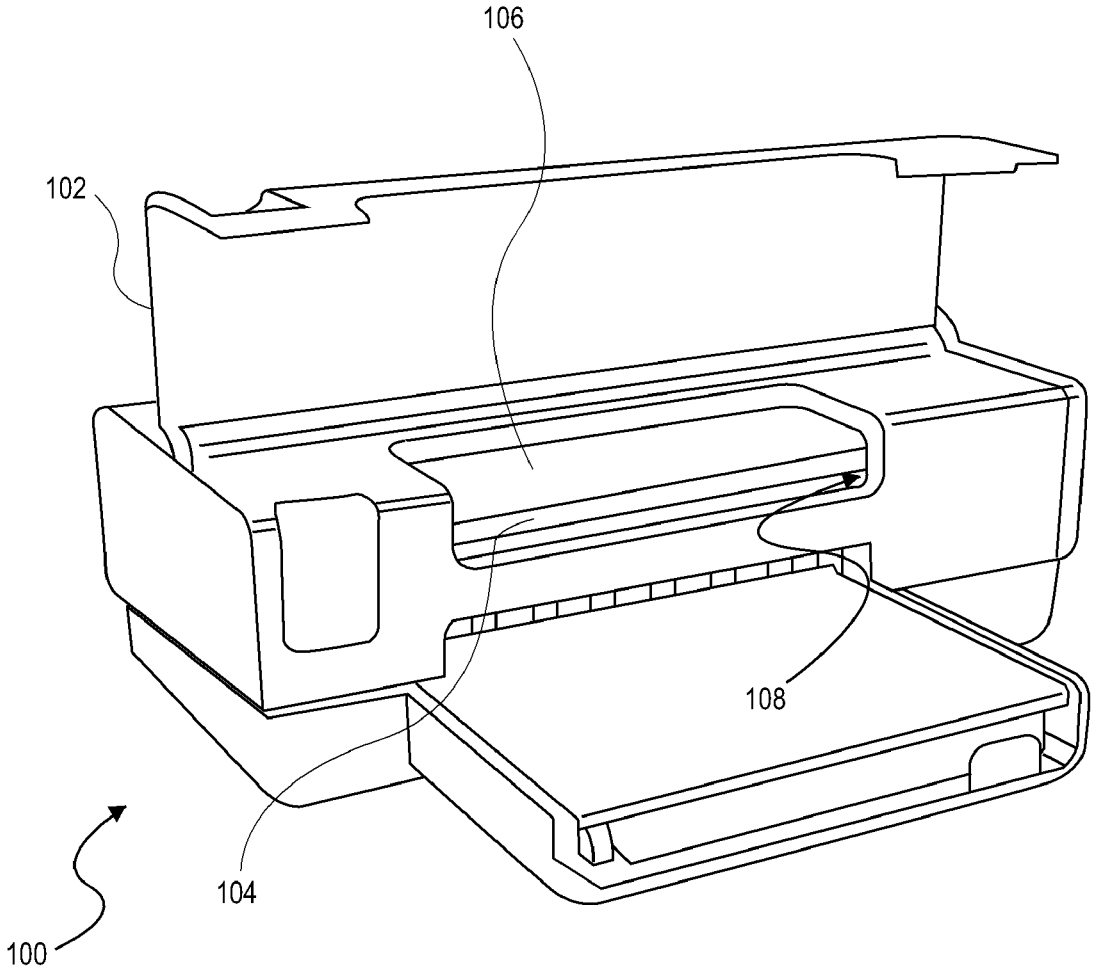
FIG. 1 is a diagram of a representative printing device, according to an embodiment of the invention.

FIG. 1 shows a representative printing device 100, according to an embodiment of the invention. The printing device 100 may be an inkjet-printing device, such as an inkjet printer, which ejects ink onto media to print images and text on media. In another embodiment, the printing device 100 may be a laser-printing device, such as a laser printer, which employs toner to print images and text on media.

The printing device 100 includes a cover 102. The cover 102 is depicted in an open position in FIG. 1, and can be moved to be in a closed position as well, as can be appreciated by those of ordinary skill within the art. When the cover 102 is in the open position, an interior portion 106 is user accessible. By comparison, when the cover 102 is in the closed position, the interior portion 106 is user inaccessible.

Another interior portion 108 is substantially inaccessible to a user regardless of whether the cover 102 is in the open position or the closed position. That is, regardless of whether the cover 102 is open or closed, it is difficult for a user to access components within the interior portion 108. This is because the interior portion 108 remains substantially hidden from view even when the cover 102 is in the open position.

The interior portions 106 and 108 contain a rod 104. The rod 104 extends from the interior portion 106 into the interior portion 108. A housing, such as a carriage, is movable along the rod 104. It is noted that the rod can be of different lengths to accommodate different sizes of media such as paper. Such a housing or carriage may include colorant enclosures, such as inkjet cartridges, for instance. Therefore, when the housing or carriage has moved on the rod 104 to the interior portion 106, it is user accessible. By comparison, when the housing or carriage has moved on the rod 104 to the interior portion 108, it is substantially user inaccessible. Thus, the rod 104 itself has a portion that is substantially user inaccessible, within the interior portion 108, and a portion that is substantially user accessible, within the interior portion 106.

Figure 2:
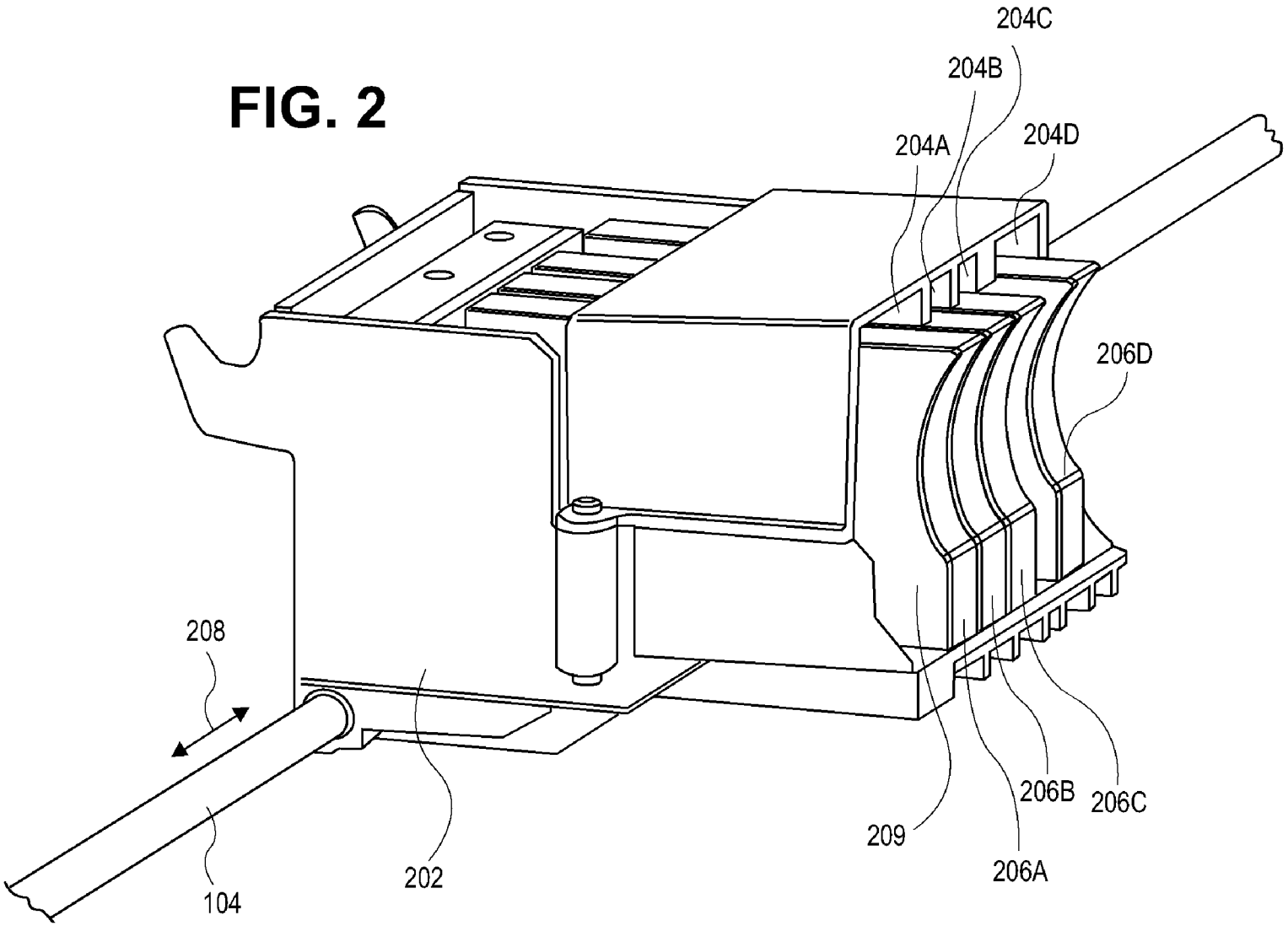
FIG. 2 is a diagram depicting a housing, or carriage, of a printing device that is movable along a rod of the printing device, according to an embodiment of the invention.

FIG. 2 shows such a housing 202 movable along the rod 104, according to an embodiment of the invention. The housing 202, which can be considered a carriage in one embodiment, is movable along the rod 104 as indicated by the bidirectional arrow 208. The housing 202 defines a number of slots 204A, 204B, 204C, and 204D, collectively referred to as the slots 204. While there are four slots 204 in the example of FIG. 2, in other embodiments there may be a different number of slots 204, such as eight, for instance. The slots 204 are receptive to insertion of corresponding colorant enclosures 206A, 206B, 206C, and 206D, collectively referred to as the colorant enclosures 206.

The colorant enclosures 206 contain colorant supplies by which the printing device 100 prints on media. For instance, the colorant enclosures 206 may be inkjet cartridges containing ink supplies, such as cyan, magenta, yellow, and black ink supplies, as well as light cyan, light magenta, red, blue, gray, and other types of ink supplies. The colorant enclosures 206 in such an embodiment may further include inkjet printheads, which are the electronics and other components used by the printing device 100 to actually eject ink onto media. The colorant supplies of the colorant enclosures 206, and optionally the inkjet printheads in such an embodiment, are contained within housings of the enclosures 206, which are not to be confused with the housing 202. For instance, the enclosure 206A is depicted in FIG. 2 as including a housing 209.

Colorant as used herein is that which is deposited on media by the printing device 100 to print on the media. Colorant does not have to be a particular color, like cyan, magenta, or yellow, but can also be black. In the case of an inkjet-printing device, the colorant is ink. In the case of a laser-printing device, the colorant is toner. Other types of printing devices, using other types of colorant, are also amenable to embodiments of the invention.

It is noted that embodiments of the invention are described substantially to colorant, which may be ink, toner, and so on. However, other embodiments of the invention are applicable to other types of consumables used by printing devices to form images on media. Such consumables can include other types of jettable fluids, in addition to ink, such as fixer, which is applied to assist adhesion of ink to media, and gloss, which is implied to impart a gloss on printed media. Other such consumables can include printheads, which may or may not include colorant supplies. Examples of jettable fluids further sealants, electrical conductors, electrical insulators, bio-agents and pharmaceutical ingredients. Therefore, while embodiments of the invention are substantially described herein in relation to consumables that are colorants, they are nevertheless applicable to non-colorant consumables as well.

Figure 3:
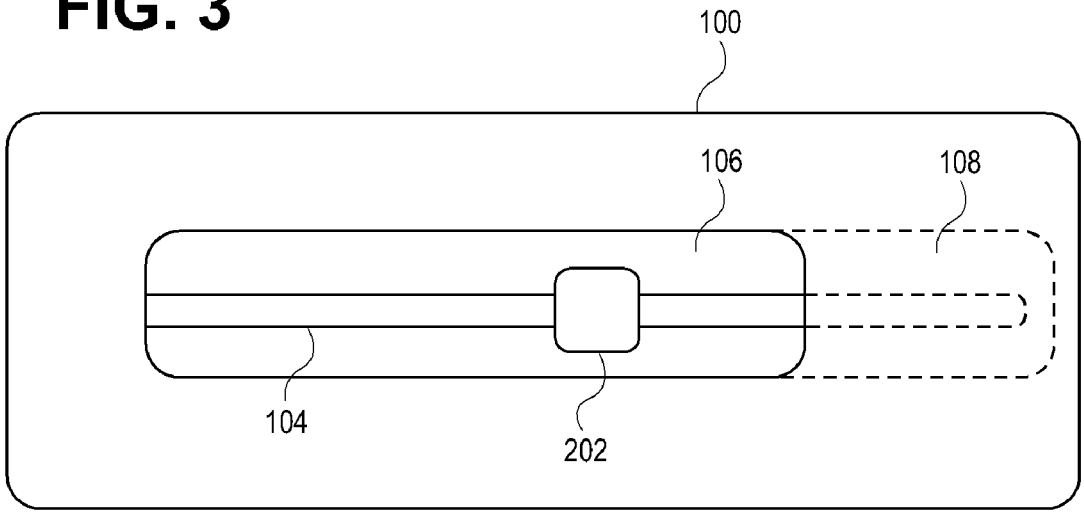
FIG. 3 is a diagram of a front view of a printing device in which an accessible interior portion and a substantially inaccessible interior portion are depicted, according to an embodiment of the invention.

FIG. 3 shows a front view of the printing device 100 that better illustrates the accessibility or inaccessibility of the housing 202 within the printing device 100, according to an embodiment of the invention. The cover 102 of the printing device 100 is not depicted in FIG. 3, but is presumed to be in the open position. Likewise, the paper tray that is depicted in FIG. 1 is not depicted in FIG. 3, for illustrative convenience. The interior portions 106 and 108 are depicted in FIG. 3 by solid and dotted lines, respectively. The rod 104 extends from the interior portion 106 to the interior portion 108, again by solid and dotted lines, respectively.

The housing 202 is shown in FIG. 3 within the interior portion 106, and thus is user accessible where the cover 102 is opened. However, because the housing 202 is movable along the rod 104, it can be moved to the interior portion 108. Even when the cover 102 is opened, the housing 202 is substantially user inaccessible when moved to the interior portion 108. This is because it is difficult for a user to access the interior portion 108 even when the cover 102 is open, since, unlike the interior portion 106, the interior portion 108 remains unexposed regardless of whether the cover 102 is in the open position or in the closed position.

Embodiments of the invention are concerned with locking the colorant enclosures 206 within the printing device 100 after they have been inserted into the housing 202. This is achieved at least by providing the printing device 100 with a locking mechanism that can be engaged and disengaged by the user. Upon engagement of such a locking mechanism, the colorant enclosures 206 are substantially impeded from removal from the housing 202 of the printing device 100 until the locking mechanism has been disengaged. The printing device 100 can detect user engagement of the locking mechanism, and in response prevent movement of the housing 202, and thus movement of the colorant enclosures 206 therewithin, to a position within the interior portion 160 in which the locking mechanism can be disengaged, until the user has entered an appropriate unlock code. Such theft deterrence of the colorant enclosures 206 is now described in detail by reference to a number of different exemplary embodiments of the invention.

Figure 4A:
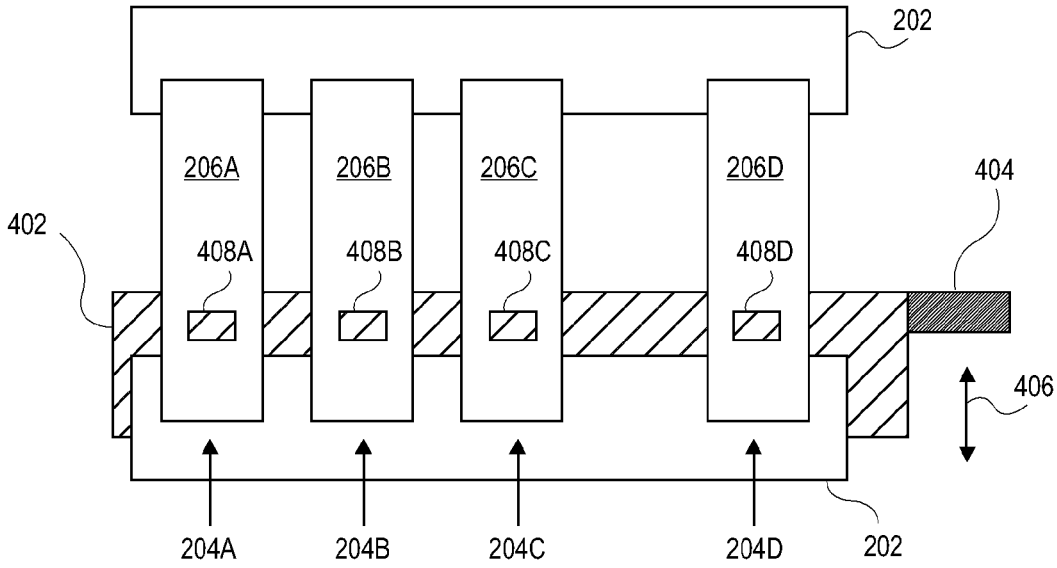
FIGS. 4A and 4B are diagrams of a front view and a side view, respectively, of a locking mechanism to secure colorant enclosures within a housing of a printing device, according to one embodiment of the invention.
Figure 4B:
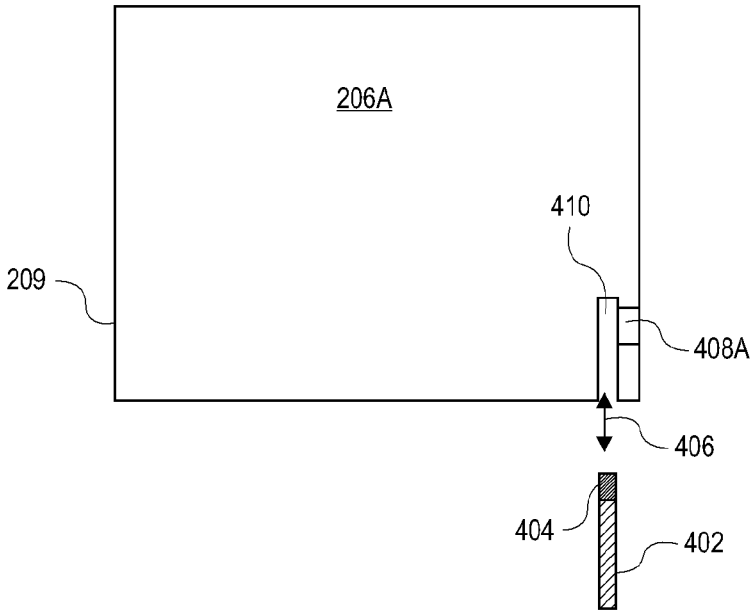

FIGS. 4A and 4B depicted such a locking mechanism to assist prevention of removal of the colorant enclosures 206 from the housing 202, according to one embodiment of the invention. FIG. 4A shows a front view of the colorant enclosures 206 inserted within the slots 204 of the housing 202. FIG. 4B shows a side view of the colorant enclosure 206A in particular, where the housing 202 is not depicted for illustrative clarity.

A tab 402 implements the locking mechanism in the embodiment of FIGS. 4A and 4B. The tab 402 has a handle 404. In the example of FIGS. 4A and 4B, the tab 402 is vertically movable from the unlocked position of FIG. 4B to the locked position of FIG. 4A, as indicated by the bi-directional arrow 406. The tab 402 may alternatively be moved from an unlocked position to a locked position in a non-vertical manner, such as in an angled manner. A user may use the handle 404 to engage the locking mechanism to the locked position of FIG. 4A, or to disengage the locking mechanism to the unlocked position of FIG. 4B. In the locked position of FIG. 4A, the colorant enclosures 206 are locked by the tab 402 such that their removal from the housing 202 is impeded. By comparison, in the unlocked position, the colorant enclosures 206 can be removed from the housing 202.

As depicted in FIG. 4B in relation to the colorant enclosure 206A specifically, the housing 209 of the colorant enclosure 206A includes a slot 410 that is receptive to the tab 402. The slot 410 is more generally a feature of the colorant enclosure 206A that is receptive to, and that cooperates with, a locking mechanism of the printing device 100. All of the colorant enclosures 206 have slots like the slot 410 of the colorant enclosure 206A in the embodiment of FIGS. 4A and 4B.

Therefore, when a user engages the tab 402 via the handle 404 by moving the tab 402 upwards, the tab 402 is inserted into the slots of the colorant enclosures 206, locking the colorant enclosures 206 within the housing 202. The colorant enclosures 206 may include at least substantially transparent windows 408A, 408B, 408C, and 408D, collectively referred to as the windows 408, to enable a user to easily assess visually whether the tab 402 is engaged in the locked position. For instance, the tab 402 may be brightly colored, such that it is easily visible within the windows 408.

Once the tab 402 has been engaged in the colorant enclosures 206, the printing device 100 may detect such engagement, as is described in more detail later in the detailed description. Thereafter, when the cover 102 of the printing device 100 is opened, the housing 202 in which the colorant enclosures 206 have been inserted is not automatically moved from the interior portion 108 to the interior portion 106 of the device 100. As such, by the housing 202 remaining partially or completely in the interior portion 108, the handle 404 of the tab 402 is substantially not accessible by the user. Therefore, the user is not easily able to disengage the tab 402 to the unlocked position in order to remove the colorant enclosures 206 from the housing 202.

In another embodiment, the housing 202 may partially move into the interior portion 106 of the printing device 100 upon opening the cover 102, but not completely, such that a portion of the housing 202 remains within the interior portion 108 of the device 100. In particular, the handle 404 of the tab 402 remains within the interior portion 108 of the printing device 100. As such, in this embodiment as well the user is not able to disengage the tab 402 to the unlocked position in order to remove the colorant enclosures 206 from the housing 202.

In the embodiment of FIGS. 4A and 4B, the slots of the colorant enclosures 206, such as the slot 410 of the colorant enclosure 206A in FIG. 4B, are located in bottom surfaces of the colorant enclosures 206. Therefore, the tab 402 is moved upwards in order to lock the colorant enclosures 206 within the housing 202. In another embodiment, however, the slots of the colorant enclosures 206 may be located in upper surfaces of the colorant enclosures 206. In such an embodiment, the tab 402 is moved downwards to lock the colorant enclosures 206 within the housing 202, as can be appreciated by those of ordinary skill within the art. It is also be noted that by changing the geometry of the locking feature on each colorant enclosure and the corresponding engagement feature on the locking rod, the resulting mechanism can be employed to ensure that the colorant supplies are in their correct locations—that the cyan colorant supply is located in the slot intended for this supply, that the black colorant supply is located in its corresponding slot, and so on.

Figure 5A:
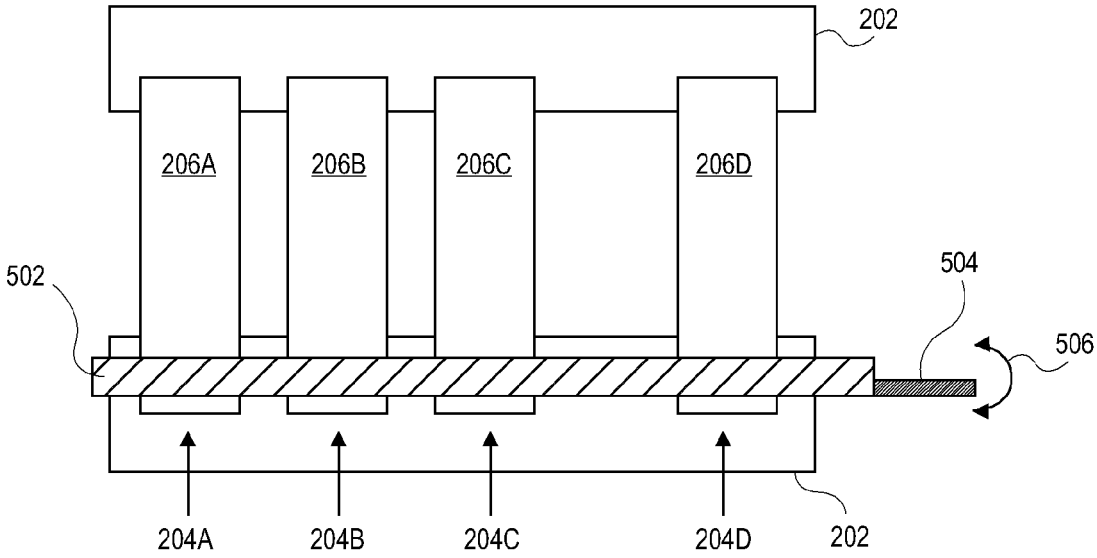
FIGS. 5A and 5B are diagrams of a front view and a side view, respectively, of a locking mechanism to secure colorant enclosures within a housing of a printing device, according to another embodiment of the invention.
Figure 5B:
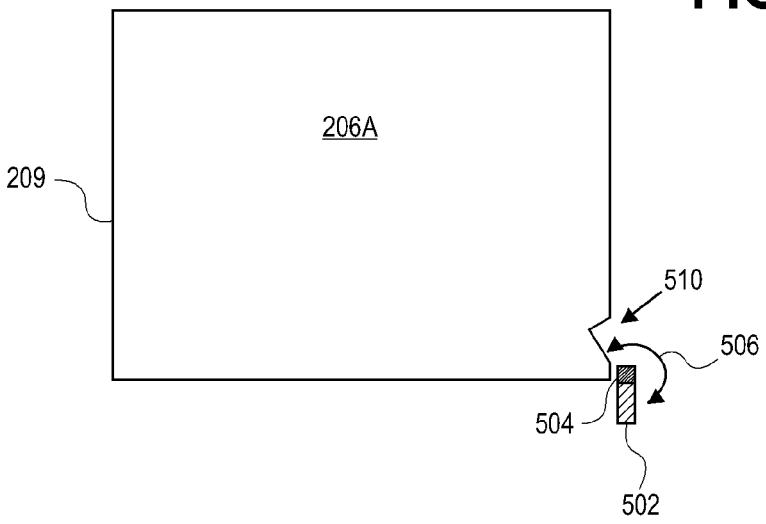

FIGS. 5A and 5B depicted a locking mechanism to assist prevention of removal of the colorant enclosures 206 from the housing 202, according to another embodiment of the invention. FIG. 5A shows a front view of the colorant enclosures 206 inserted within the slots 204 of the housing 202. FIG. 5B shows a side of the colorant enclosure 206A in particular, where the housing 202 is not depicted for illustrative clarity.

A tab 502 implements the locking mechanism in the embodiment of FIGS. 5A and 5B. The tab 502 has a lever 504. The tab 502 is rotatable from the unlocked position of FIG. 5B to the locked position of FIG. 5A, as indicated by the bi-directional arrow 506. A user may use the lever 504 to rotate the tab 502 to engage the locking mechanism to the locked position of FIG. 5A, or to use the lever 504 to rotate the tab 502 to disengage the locking mechanism to the unlocked position of FIG. 5B. In the locked position of FIG. 5A, the colorant enclosures 206 are locked by the tab 502 such that their removal from the housing 202 is impeded. By comparison, in the unlocked position, the colorant enclosures 206 can be removed from the housing 202.

As depicted in FIG. 5B in relation to the colorant enclosure 206A specifically, the housing 209 of the colorant enclosure 206A includes a V-shaped notch 510 that is receptive to the tab 502. The notch 510 is more generally a feature of the colorant enclosure 206A that is receptive to, and that cooperates with, a locking mechanism of the printing device 100. All of the colorant enclosures 206 have notches like the notch 510 of the colorant enclosure 206A in the embodiment of FIGS. 5A and 5B. The notch 510 in the embodiment of FIGS. 5A and 5B is formed completely across the front surface of the enclosure 206A (as well as the notches of the other enclosures), where this front surface is that which is shown in FIG. 5A. However, in another embodiment, the notch may not be formed completely across the front surface. The notch can in one embodiment having a receiving geometry corresponding to the receiving geometry of the corresponding locking feature, such that locking is possible just when each colorant enclosure is in its correct slot. Thus, a cyan colorant enclosure inserted into the slot intended for a black colorant enclosure, for example, will result in locking not being possible.

Therefore, when a user engages the tab 502 via the lever 504 by rotating the tab 502 upwards, the tab 502 is inserted into the notches of the colorant enclosures 206, locking the colorant enclosures 206 within the housing 202. Once the tab 502 has been engaged in the colorant enclosures 206, the printing device 100 may detect such engagement, as is described in more detail later in the detailed description. Thereafter, when the cover 102 of the printing device 100 is opened, the housing 202 in which the colorant enclosures 206 have been inserted is not automatically moved from the interior portion 108 to the interior portion 106 of the device 100. As such, by the housing remaining in the interior portion 108, the lever 504 of the tab 502 is substantially not accessible by the user. Therefore, the user is not easily able to disengage the tab 502 to the unlocked position in order to remove the colorant enclosures 206 from the housing 202.

In another embodiment, the housing 202 may partially move into the interior portion 106 of the printing device 100 upon opening the cover 102, but not completely, such that a portion of the housing 202 remains within the interior portion 108 of the device 100. In particular, the lever 504 of the tab 502 remains within the interior portion 108 of the printing device 100. As such, in this embodiment as well the user is not able to disengage the tab 502 to the unlocked position in order to remove the colorant enclosures 206 from the housing 202.

In the embodiment of FIGS. 5A and 5B, the notches of the colorant enclosures 206, such as the notch 510 of the colorant enclosure 206A in FIG. 5B, are located in bottom surfaces of the colorant enclosures 206. Therefore, the tab 502 is rotated upwards in order to lock the colorant enclosures 206 within the housing 202. In another embodiment, however, the notches of the colorant enclosures 206 may be located in upper surfaces of the colorant enclosures 206. In such an embodiment, the tab 502 is rotated downwards to lock the colorant enclosures 206 within the housing 202, as can be appreciated by those of ordinary skill within the art.

Figure 6A:
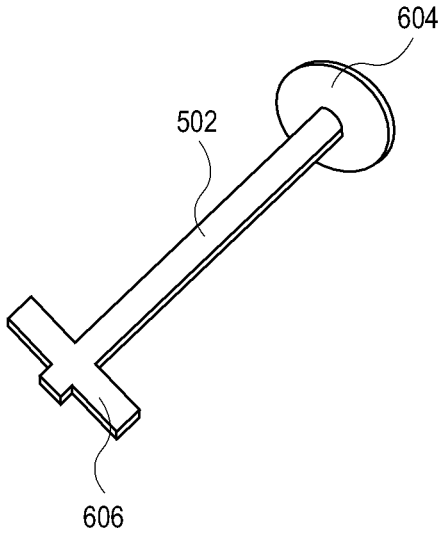
FIGS. 6A, 6B, and 6C are diagrams of a locking mechanism to secure colorant enclosures within a housing of a printing device that includes a T-shaped end, and of how this locking mechanism can be used, according to an embodiment of the invention.

FIG. 6A shows the tab 502 that can implement the locking mechanism of the printing device 100, according to another embodiment of the invention. In the embodiment of FIG. 6A, the lever 504 of FIGS. 5A and 5B is replaced by a rotatable wheel 604. Therefore, a user uses the wheel 604 to rotate the tab 502 to the locked position of FIG. 5A and the unlocked position of FIG. 5B, and vice-versa.

Furthermore, the tab 502 is depicted as including a T-shaped end 606 in the embodiment of FIG. 6A. The T-shaped end 606 may further be added by itself to the embodiment of FIGS. 5A and 5B, and/or the embodiment of FIGS. 4A and 4B, without the wheel 604. The T-shaped end 606 of the tab 502 provides additional locking functionality. This is now described in more detail in relation to one particular embodiment of the invention.

Figure 6C:
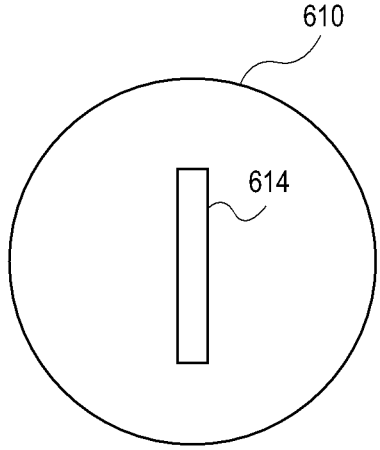
Figure 6B:
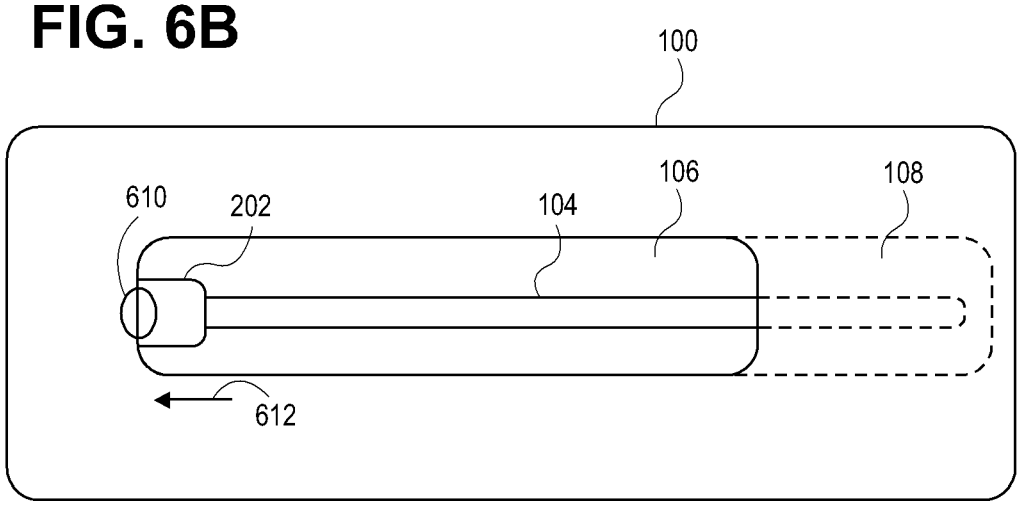

FIG. 6B shows a front view of the printing device 100, according to an embodiment of the invention. As in FIG. 3, the cover 102 is in the opened position in FIG. 6B, exposing the interior portion 106 of the printing device 100, but still keeping hidden the interior portion 108 of the device 100. As has been described in relation to FIGS. 4A and 4B, and to FIGS. 5A and 5B, when the cover 102 is opened, the housing 202 is at least partially moved to the interior portion 108 so that the handle 404 (in the embodiment of FIGS. 4A and 4B) or the lever 504 (in the embodiment of FIGS. 5A and 5B) is not easily accessible by the user to disengage the locking mechanism.

By comparison, in the embodiment of FIG. 6B, the housing 202 is moved along the rod 104 to the far left of the interior portion 106 of the printing device 100. This can be beneficial to the user, insofar as the user is able to completely view the housing 202 and its constituent colorant enclosures 206 within the exposed interior portion 106. By comparison, in the embodiment of FIGS. 4A and 4B and of FIGS. 5A and 5B, the housing 202 and its constituent colorant enclosures 206 are at least partially hidden within the unexposed interior portion 108. However, in FIG. 6B, the wheel 604 (or the handle 404 or the lever 504) is easily accessible by the user, since the wheel 604 is exposed within the interior portion 106.

In this situation, to prevent the user from disengaging the locking mechanism unless he or she is authorized to do so, the T-shaped end 606 of the tab 502 is inserted into a corresponding slot at a location 610 at the end of the interior portion 106 of the printing device. The slot is keyed to the T-shaped end 606 so that it is receptive to the T-shaped end 606 when the tab 502 is in the locked position. Once inserted into the slot, the T-shaped end 606 cannot be rotated. As a result, the tab 502 itself cannot be rotated by the user via the wheel 604 to disengage the tab 502 to the unlocked position, even though the wheel 604 is exposed to the user in FIG. 6B. (It is noted that while the location 610 is depicted in the example of FIG. 6B as being on the left side, in another embodiment it may also be located on the right side.)

FIG. 6C shows the location 610 in more detail, from the view indicated by the arrow 612 in FIG. 6B, according to an embodiment of the invention. A slot 614 is receptive to the T-shaped end 606 when the T-shaped end 606 has been rotated to a vertical position as a result of the tab 502 being rotated to the locked position via user control of the wheel 604. The T-shaped end 606, in other words, fits into the slot 614. When in the slot 614, the T-shaped end 606 cannot be rotated, and is effectively locked. This means that the tab 502 cannot be rotated to the unlocked position via user control of the wheel 604. Therefore, in the embodiment of FIGS. 6B and 6C, even though the housing 202 and the wheel 604 are exposed within the interior portion 106 of the printing device 100, the user nevertheless cannot disengage the locking mechanism to the unlocked position to remove the colorant enclosures 106 from the housing 202.

Figure 7:
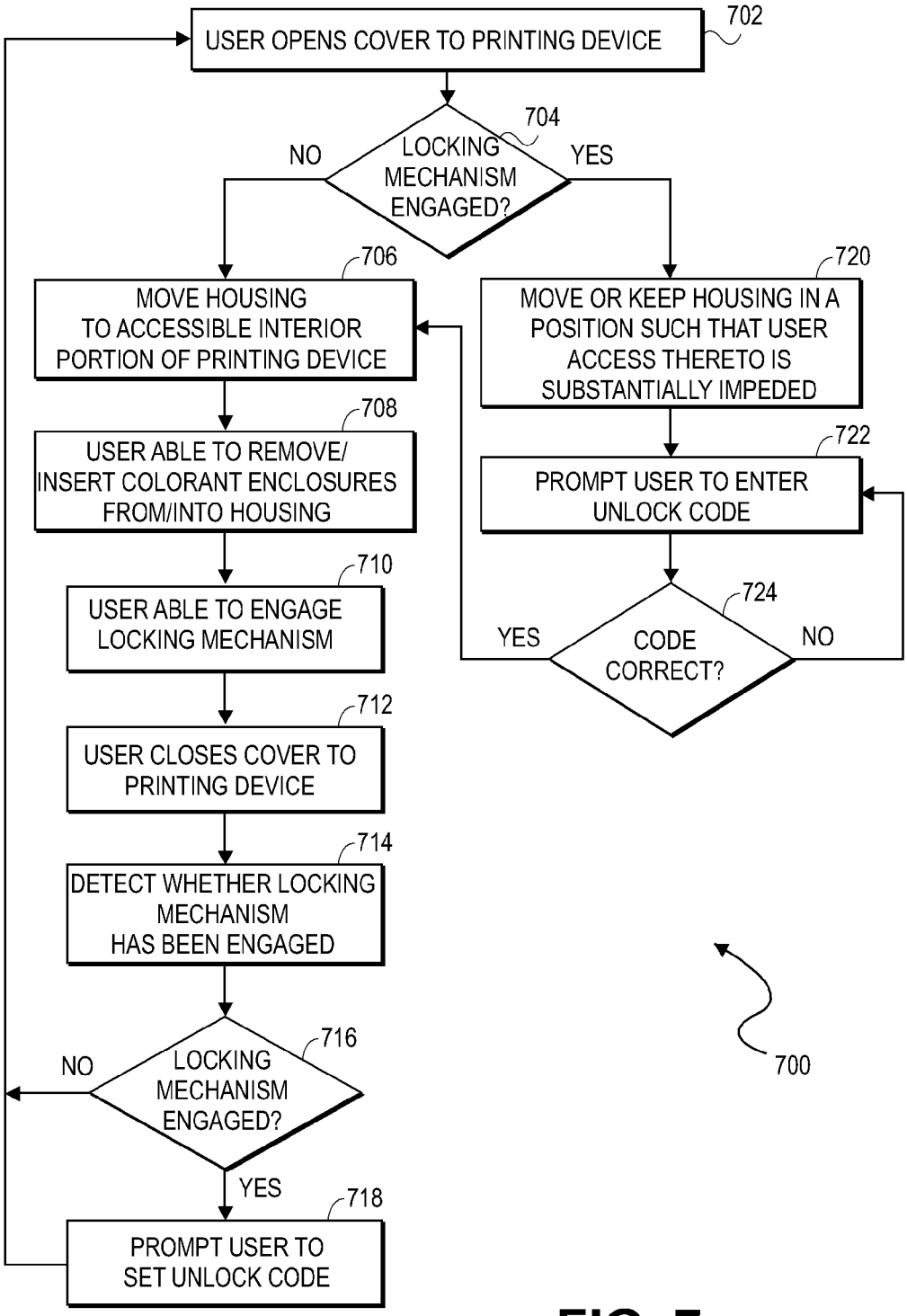
FIG. 7 is a flowchart of a method by which a locking mechanism is used to assist in preventing removal of colorant enclosures from a housing of a printing device, according to an embodiment of the invention.

FIG. 7 shows a method 700 by which the locking mechanism of the printing device 100 can be employed, according to an embodiment of the invention. At some point, the user opens the cover 102 to the printing device 100 (702). The printing device 100 looks up whether the locking mechanism was previously engaged by the user (704). For description purposes, it is presumed that the user had not previously engaged the locking mechanism. This may be the case, for instance, where the printing device 100 has been newly purchased and the user is using it for the first time.

Therefore, the printing device 100 moves the housing 202 along the rod 104 to the accessible interior portion 106 of the printing device 100 (706). As such, the user is able to remove colorant enclosures 206 from the slots 204 of the housing 202, as well as insert colorant enclosures 206 into the slots 204 of the housing 202 (708). The user is also able to engage the locking mechanism (710). For example, the user may move the tab 402 of FIGS. 4A and 4B vertically upwards via the handle 404, rotate the tab 502 of FIGS. 5A and 5B upwards via the lever 504, or rotate the tab 502 of FIG. 6A upwards via the wheel 604. The user then closes the cover 102 to the printing device 100 (712).

The printing device 100 then detects whether the locking mechanism has been engaged (714). In one embodiment, for instance, an appropriately placed optical sensor may detect that the tab 402 or the tab 502 has been moved or rotated to the locked position, or that the tab 402 or the tab 502 is no longer in the unlocked position. In another embodiment, movement of the tab 402 or the tab 502 may effectively increase the width of the housing 202 due to, for instance, the extra width afforded by the handle 404, the lever 504, and/or the T-shaped end 606.

For instance, the printing device 100 may attempt to move the housing 202 to a certain location at the end of the interior portion 106 or 108 that the housing 202 can reach if the handle 404, the lever 504, and/or the T-shaped end 606 is not in the way when the locking mechanism is in the unlocked position. By comparison, where the locking mechanism is in the locked position, such that the handle 404, the lever 504, and/or the T-shaped end 606 effectively increases the width of the housing 202, the housing 202 may not be able reach this location. Therefore, the printing device 100 is able to conclude that the locking mechanism has been engaged to the locked position.

If the locking mechanism has been detected as having been engaged by the user (716), then the user can be prompted to set an unlock code (718). Alternatively, an unlock code may have or could be set at a different time, before or after the locking mechanism is engaged. The unlock code may be a numeric code of a number of digits, or may be another type of unlock code. For example, for printing devices that do not have numeric buttons, the user may be a series of long and short pushes of an existing button on a printing device, as in Morse code, where the printing device indicates whether a long or a short push of the button has been entered via a buzzer or speaker. The unlock code may be entered via a user interface on the printing device 100 itself, or via a computing device to which the printing device 100 is communicatively connected.

The method 700 then repeats, such that at some later point the user again opens the cover to the printing device 100 (702). Presuming that the locking mechanism was indeed engaged by the user (704), the printing device 100 moves the housing 202 thereof to a position in which user access to the housing 202 is substantially impeded, or keeps the housing 202 in such a position if it previously has been moved there (720). As such, the user is substantially prevented from disengaging the locking mechanism. For instance, as has been described, the housing 202 may be moved to the substantially inaccessible portion 108 of the printing device 100, or moved so that a part of the housing 202 is within the accessible portion 106 of the printing device 100. In the embodiment of FIGS. 6A, 6B, and 6C, the housing 202 may be moved to the far left of the accessible portion 106, where insertion of the T-shaped end 606 into the slot 614 prevents the user from disengaging the locking mechanism.

The user is then prompted to enter the unlock code (722). The user may be prompted to enter the unlock code on the printing device 100 itself, or on a computing device to which the printing device 100 is communicatively connected. If the unlock code is entered correctly (724), then the method 700 proceeds to part 706, as has been described. Otherwise, the printing device 100 again prompts the user to enter the unlock code (722). As such, the user is prevented access to the locking mechanism, in that the user is substantially prevented from disengaging the locking mechanism. Therefore, the user is unable to remove the colorant enclosures 206 inserted into the housing 202 of the printing device 100.

Figure 8:
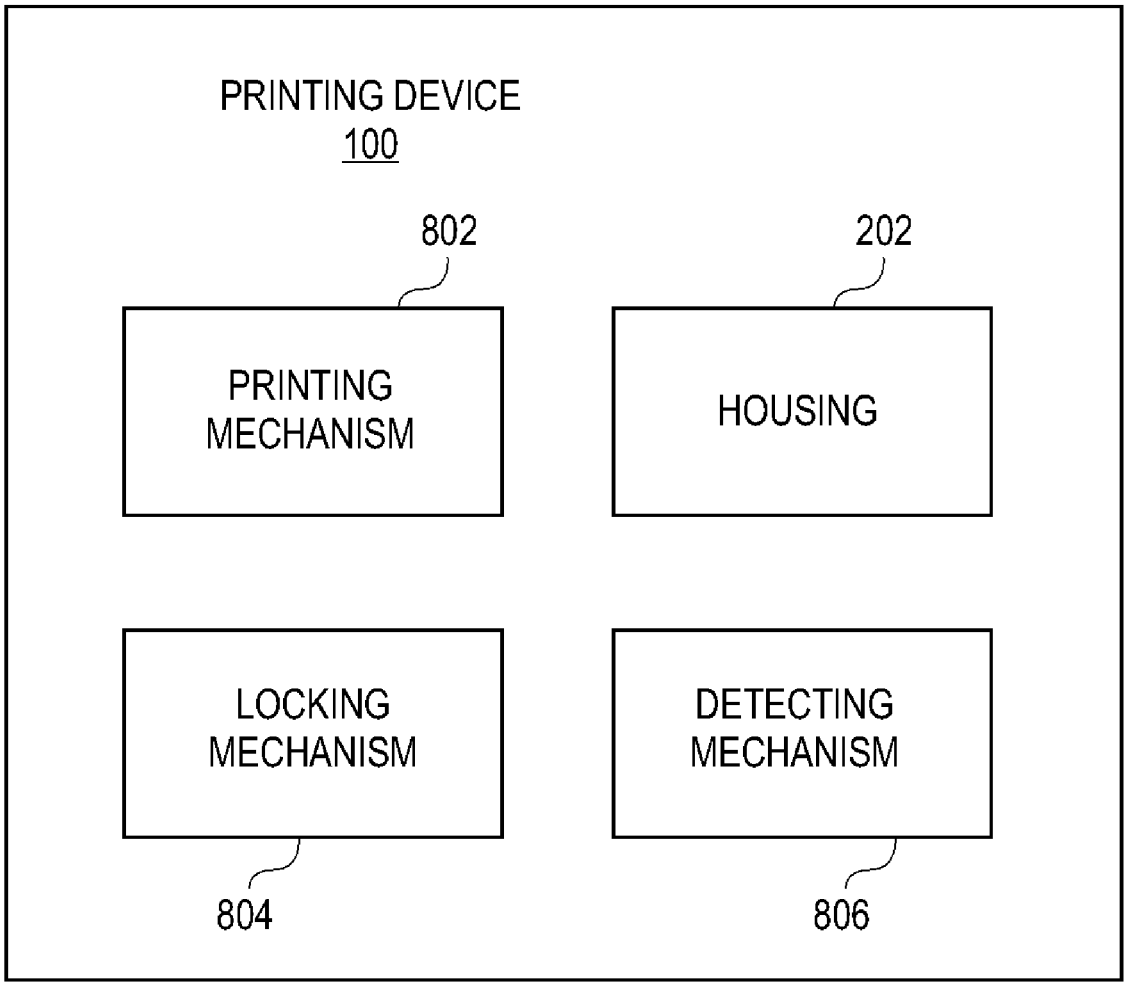
FIG. 8 is a rudimentary block diagram of a printing device, according to an embodiment of the invention.

In conclusion, FIG. 8 shows a rudimentary block diagram of the printing device 100, according to an embodiment of the invention. The printing device 100 includes a printing mechanism 802, the housing 202, a locking mechanism 804, and a detecting mechanism 806. As can be appreciated by those of ordinary skill within the art, the printing device 100 may include other components, in addition to and/or in lieu of those depicted in FIG. 8.

The printing mechanism 802 is the mechanism by which the printing device 100 is able to print images and text on media, such as paper. The printing mechanism 802 may be an inkjet-printing mechanism where the printing device 100 is an inkjet-printing device, a laser-printing mechanism where the printing device 100 is a laser-printing device, and so on. The printing mechanism 802 can be, include, or employ the colorant enclosures 206 that have been described. For instance, where the colorant enclosures 206 are inkjet cartridges containing both ink supplies and inkjet printheads, the printing mechanism 802 may be or encompass these enclosures.

The housing 202 is the component of the printing device 100 that is receptive to the colorant enclosures 206. The locking mechanism 804 is the component of the printing device 100 that can be engaged by the user to substantially assist in preventing unauthorized removal of the colorant enclosures 206 from the housing 202. For instance, the locking mechanism 804 can be implemented as shown in and as has been described in relation to FIGS. 4A and 4B, FIGS. 5A and 5B, and/or FIGS. 6A, 6B, and 6C. Finally, the detecting mechanism 806 is the component of the printing device 100 that detects whether the user has engaged the locking mechanism 804 to the locked position.

In one embodiment, the detecting mechanism 806 may be an optical sensor that detects presence or absence of the locking mechanism 804 with respect to a particular location, such that such presence or absence indicates that the locking mechanism 804 has been engaged. For example, because the tab 402 of FIGS. 4A and 4B and the tab 502 of FIGS. 5A and 5B is moved when engaged, an optical sensor is able to detect whether the tab 402 and the tab 502 is in a given position corresponding to engagement or disengagement. In another embodiment, the detecting mechanism 806 may detect whether the width of the housing 202 has been effectively extended by the locking mechanism 804, as has been described in relation to the method 700 of FIG. 7.

Those of ordinary skill within the art can appreciate that variations on what has been described can be implemented without deviating from the scope of one or more embodiments of the claimed invention. For instance, audible and/or visual feedback can be provided to the user to indicate that the locking mechanism has been engaged. As one example, when the locking mechanism has been engaged and the door to the printing device is open, a given flashing light sequence on one or more lights (such as light-emitting diodes) of the device may be initiated to draw attention to the fact that the housing containing the supply of colorant is locked within the device. As another example, when the user engages the locking mechanism, a mechanically generated noise (such as a relatively loud snap) or an electrically generated noise (such as a series of particular tones) may be initiated to provide feedback that the locking mechanism has been engaged.

We claim:

1. A method comprising:

a user inserting one or more consumable enclosures into one or more corresponding slots of a housing of a printing device, the printing device having a cover and a rod, the housing movable along the rod, the cover having a closed position in which the housing and the rod are inaccessible and an open position in which the rod is partially accessible;

the user engaging a locking mechanism of the printing device into a corresponding feature of each consumable enclosure;

the printing device detecting user engagement of the locking mechanism;

in response to a user performing a consumable enclosure-related action, including moving the cover to the open position, the printing device substantially impeding user access to the locking mechanism and the consumable enclosures, in that the housing and the locking mechanism remain substantially inaccessible by the user along a portion of the rod that is substantially inaccessible by the user, until the user has entered an unlock code.

2. The method of claim 1, further comprising in response to the user entering the unlock code, the printing device providing user access to the locking mechanism and the consumable enclosures such that the locking mechanism is disengageable by the user for removal of the consumable enclosures from the printing device.

3. The method of claim 1, wherein the printing device is an inkjet-printing device and consumable enclosures are inkjet cartridges.

4. The method of claim 1, wherein at least one of the consumable enclosures is a non-colorant consumable enclosure.

5. A printing device comprising:

a housing defining one or more slots, each slot receptive to a consumable enclosure containing a supply of consumable usable by the printing device to print on media; and, a locking mechanism having an unlocked position in which the consumable enclosures are insertable into and removable from the slots, and a locked position in which removal of the consumable enclosures from the slots is impeded by the locking mechanism, wherein the locking mechanism comprises a tab rotatable into the consumable enclosures in the locked position to impede removal of the consumable enclosures from the slots, and wherein the tab comprises a T-shaped element at an end of the tab insertable into a different slot of the housing to secure the locking mechanism in the locked position.

6. The printing device of claim 5, further comprising a detecting mechanism to detect that the locking mechanism has been engaged from the unlocked position to the locked position by a user.

7. The printing device of claim 5, wherein the locking mechanism is movable to the locked position only where each slot contains an intended consumable enclosure.

8. The printing device of claim 5, further comprising:

a rod along which the housing is movable;

a cover having a closed position in which the housing and the rod are inaccessible and having an open position in which the rod is partially accessible, wherein where the locking mechanism is in the locked position and the cover has been moved to the open position, the housing moves along the rod such that the locking mechanism is user disengageable from the locked position to the unlocked position upon user entry of an unlock code.

9. The printing device of claim 8, wherein where the locking mechanism is in the locked position and the cover has been moved to the open position, and prior to user entry of the unlock code, the housing and the locking mechanism remain substantially inaccessible by the user along a portion of the rod that is substantially inaccessible by the user.

10. The printing device of claim 9, where the locking mechanism is in the locked position and the cover has been moved to the open position, and prior to user entry of the unlock code, the housing and the locking mechanism are not moved along the rod to an accessible portion of the rod to remain substantially inaccessible by the user.

11. The printing device of claim 9, where the locking mechanism is in the locked position and the cover has been moved to the open position, and prior to user entry of the unlock code, the housing and the locking mechanism are moved along the rod such that the housing and the locking mechanism are viewable by the user but the locking mechanism remains inaccessible by the user in that user disengagement of the locking mechanism is impeded.

12. The printing device of claim 5, wherein the printing device is an inkjet-printing device and each consumable enclosure is an inkjet cartridge.

13. A printing device comprising:

a housing defining one or more slots, each slot receptive to a consumable enclosure containing a supply of consumable usable by the printing device to print on media;

a locking mechanism having an unlocked position in which the consumable enclosures are insertable into and removable from the slots, and a locked position in which removal of the consumable enclosures from the slots is impeded by the locking mechanism; and, a rod along which the housing is movable;

a cover having a closed position in which the housing and the rod are inaccessible and having an open position in which the rod is partially accessible, wherein where the locking mechanism is in the locked position and the cover has been moved to the open position, the housing moves along the rod such that the locking mechanism is user disengageable from the locked position to the unlocked position upon user entry of an unlock code.

14. The printing device of claim 13, wherein the locking mechanism comprises one of:

a first tab vertically movable into the consumable enclosures in the locked position to impede removal of the consumable enclosures from the slots;

a second tab rotatable into the consumable enclosures in the locked position to impede removal of the consumable enclosures from the slots;

a handle, lever, or wheel by which a user engages and disengages the locking mechanism.

15. The printing device of claim 13, further comprising a detecting mechanism to detect that the locking mechanism has been engaged from the unlocked position to the locked position by a user.

16. The printing device of claim 13, wherein the locking mechanism is movable to the locked position only where each slot contains an intended consumable enclosure.

17. The printing device of claim 13, wherein where the locking mechanism is in the locked position and the cover has been moved to the open position, and prior to user entry of the unlock code, the housing and the locking mechanism remain substantially inaccessible by the user along a portion of the rod that is substantially inaccessible by the user.

18. The printing device of claim 17, where the locking mechanism is in the locked position and the cover has been moved to the open position, and prior to user entry of the unlock code, the housing and the locking mechanism are not moved along the rod to an accessible portion of the rod to remain substantially inaccessible by the user.

19. The printing device of claim 17, where the locking mechanism is in the locked position and the cover has been moved to the open position, and prior to user entry of the unlock code, the housing and the locking mechanism are moved along the rod such that the housing and the locking mechanism are viewable by the user but the locking mechanism remains inaccessible by the user in that user disengagement of the locking mechanism is impeded.

20. The printing device of claim 13, wherein the printing device is an inkjet-printing device and each consumable enclosure is an inkjet cartridge.

* * * * *